US005444889A

United States Patent [19]

Barre

[11] Patent Number: 5,444,889

[45] Date of Patent: Aug. 29, 1995

[54] TOOTHBRUSH ASSEMBLY

[75] Inventor: Bertrand Barre, Dommartin, France

[73] Assignee: Chesebrough-Pond's USA Co., Division of Conopco, Inc., Greenwich, Conn.

[21] Appl. No.: 233,601

[22] Filed: Apr. 19, 1994

[30] Foreign Application Priority Data

Apr. 29, 1993 [GB] United Kingdom ..... 9308903

[51] Int. Cl.[6] ..... A46B 9/04

[52] U.S. Cl. ..... 15/167.1; 15/143.1; 15/257.01; 132/308; 248/111; 248/908; D4/107; D4/108; D6/534

[58] Field of Search ..... 15/143.1, 167.1, 146, 15/246, 257.01; 132/308; 211/65; 248/110, 111, 519, 908, 915; D4/107, 108, 124–126, 199; D6/528, 534

[56] References Cited

U.S. PATENT DOCUMENTS

| | | | |
|---|---|---|---|
| D. 209,574 | 12/1967 | Zandberg et al. | D4/107 |
| D. 279,248 | 6/1985 | Oliver | D6/534 |
| 904,650 | 11/1908 | Sampson et al. | 211/65 |
| 1,326,162 | 12/1919 | Anagnosto Poulos | 248/519 |
| 1,618,027 | 2/1927 | Vogler | 211/65 |
| 1,659,622 | 2/1928 | Atamian | 15/143.1 |
| 1,690,311 | 11/1928 | Reich | 248/110 |
| 2,416,684 | 3/1947 | Fischer | 15/167.1 |
| 2,539,035 | 1/1951 | Scanlon et al. | 248/110 |
| 2,567,080 | 9/1951 | Pifer | 15/167.1 |
| 2,617,617 | 11/1952 | Krastel et al. | 248/519 |
| 3,138,813 | 6/1964 | Kaplan . | |
| 3,170,265 | 2/1965 | Goldfarb | D6/534 |
| 3,178,060 | 4/1965 | Bossack . | |
| 3,325,847 | 6/1967 | Meranto | D4/108 |
| 5,187,829 | 2/1993 | Atkins | 15/167.1 |
| 5,269,420 | 12/1993 | Harrison et al. | 206/362.3 |

FOREIGN PATENT DOCUMENTS

| | | | |
|---|---|---|---|
| 676939 | 6/1939 | Germany | 132/308 |
| 3149233 | 4/1983 | Germany | 15/167.1 |
| 3871 | of 1888 | United Kingdom | 15/143.1 |
| 20664 | of 1896 | United Kingdom | 248/519 |
| 84-01700 | 5/1989 | WIPO | 15/143.1 |

*Primary Examiner*—Mark Spisich
*Attorney, Agent, or Firm*—Milton L. Honig

[57] ABSTRACT

A toothbrush assembly including a toothbrush having a head portion with bristles attached thereto, and a handle portion, on a free-standing stand for the brush, the stand being capable of retaining the brush in a substantially upright position.

6 Claims, 2 Drawing Sheets

TOOTHBRUSH ASSEMBLY

BACKGROUND OF THE INVENTION

1. Field of the Invention

This invention relates to a toothbrush assembly, and to a method of drying a toothbrush, in particular to a method and system which may have particular appeal to children, and therefore may be of use in promoting generally improved dental health.

2. The Related Art

Since time immemorial man has been using brushes or similar implements to clean his teeth, thereby leading to improved dental health. A typical toothbrush may comprise an elongate handle designed to be comfortably held in the hand, and a head portion comprising a plurality of bristles which may be maneuvred by the handle in the users mouth.

It has also long been known that, after use, it is desirable that a toothbrush be permitted to dry as fast as possible. This is so as to try to prevent growth on the brush of undesirable microorganisms, which may grow in what may otherwise be a highly desirable environment for them. Certainly the environment will be moist, and if the brush is kept in the bathroom of a house the temperature may also be relatively high, for example typically in the range 15°–30° C. Such conditions may typically be conditions in which microbes thrive.

However, in facilitating the drying of toothbrushes, it may also be considered desirable to dry the brush in what is substantially an upright position, as opposed to lying the brush on a horizontal surface. Often when this is done the brush is left with the bristles pointing upright. This is because a brush drying in such a horizontal position may take up excessive space in what is commonly a relatively small room in the house (especially if there is more than one brush drying), but more importantly it is thought that the drying of brushes in such a horizontal position may be relatively unhygienic. This is because a brush drying horizontally with upwardly facing bristles provides a large bristle area upon which undesirable airborne bacteria may land. Also, a brush drying in such a horizontal position may facilitate the flow of any water retained on the brushhead or bristles into the tuft holes of the brush. It is relatively difficult for water retained in the tuftholes to evaporate, and thereby this accumulation of water may facilitate the aforementioned undesirable microbial growth.

It may therefore be considered desirable for toothbrushes to dry after use in a substantially upright position. A problem with providing such drying however is that after using a toothbrush the user simply cannot be bothered to orientate the brush such that it dries in a substantially upright position. Such a problem may be experienced particularly with children, who are even less likely than adults to be concerned with undesirable microbial growth on their toothbrush. The current invention sets out to overcome these problems, and others which may be experienced with current toothbrushing regimes.

SUMMARY OF THE INVENTION

Thus, according to a first aspect of the invention, there is provided a toothbrush assembly comprising a toothbrush having a head portion with bristles attached thereto, and a handle portion, and a free-standing stand for the brush, the stand being capable of retaining the brush in a substantially upright position, the stand and brush both having co-operating means so as to allow the brush to be releasably retained by the stand.

According to a further aspect of the invention, there is provided a method of drying a toothbrush having a head portion with bristles attached thereto, and a handle portion, comprising standing the brush in a free-standing stand for the brush, the stand being capable of retaining the brush in a substantially upright position, the stand and brush both having co-operating means so as to allow the brush to be releasably retained by the stand.

The stand for the toothbrush in the assembly according to the invention should be capable of free standing, that is it should be capable of supporting itself and the brush on a substantially horizontal surface. The stand should not require mounting in any way, for example by being attached to a wall.

In a preferred embodiment of the invention, the co-operating means on the brush is located remote from the head on the handle of the brush, preferably as remote as possible from the head of the brush.

The co-operating means of the stand and brush should be such as to facilitate the gripping and releasing of the brush by the stand. Such co-operating means may take any form which readily grip and release each other, but may preferably be releasable ball and socket shaped co-operating means, with the ball portion of the co-operating means being molded integrally with the handle of the brush. In such an embodiment, the end of the brush remote from the head may have a generally rounded appearance. In this embodiment, the socket shaped receiving means of the co-operating means may be integrally molded with the stand, and will have side walls shaped so as to retain the brush in a substantially upright position in use.

As well as having portions which must be capable of releasably retaining the brush, the stand may preferably have several other desirable features. The stand, as well as the brush, may be manufactured from molded plastics materials using conventional techniques. The stand should also be as stable as possible, providing a stable structure which does not readily topple over when the brush or stand is knocked.

In a highly preferred embodiment of the invention, the stand for the brush may be shaped so as to be aesthetically pleasing to the users, in particular to young children. Such an aesthetic assembly may arise from the shape of the stand in itself, but also more particularly from the combination of brush and stand. To this end, the stand may be shaped so as to be both functional and to provide amusement for children, and thus may for example comprise in a preferred embodiment a pair of legs, which may be caricatured or otherwise, conveniently attached to a pair of feet (similarly caricatured or otherwise), which may be shaped in such a way as to provide the stand with good degree of stability in use. The overall brush and stand assembly may preferably have some caricature resemblance to a figure, such as a man or a cartoon character.

Thus this highly preferred embodiment of the invention comprises a toothbrush assembly comprising a toothbrush having a head portion with bristles attached thereto, and a handle portion, and a free-standing stand for the brush, the stand being capable of retaining the brush in a substantially upright position, the stand and brush both having cooperating means so as to allow the brush to be releasably engaged by the stand, the stand having a plurality of legs. Preferably each leg has a foot attached to it.

With regard to providing an assembly which is as stable as possible, the stand and brush combination may be best designed such that, when the brush is in place on the stand, the center of gravity of the assembled brush/-stand lies in relation to the base of the stand so as to provide a stable structure.

BRIEF DESCRIPTION OF THE DRAWING

The invention will now be described by way of example only, with reference to the accompanying figures, in which.

DETAILED DESCRIPTION

Figure 1:
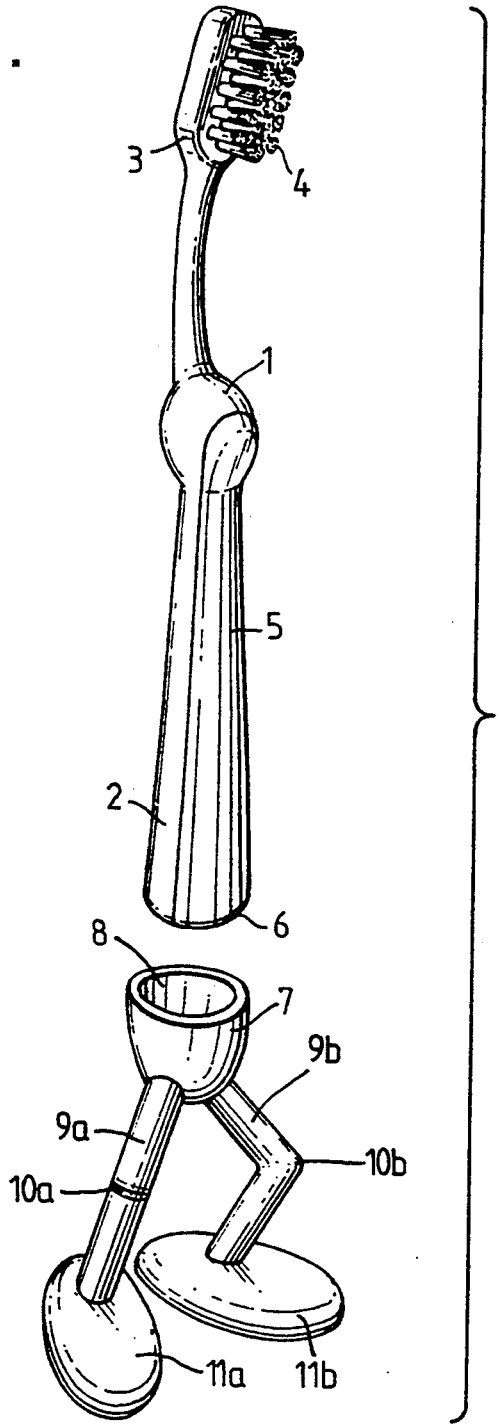
FIG. 1 shows an isometric perspective of the brush assembly according to the invention with the brush and stand separated.
Figure 2:
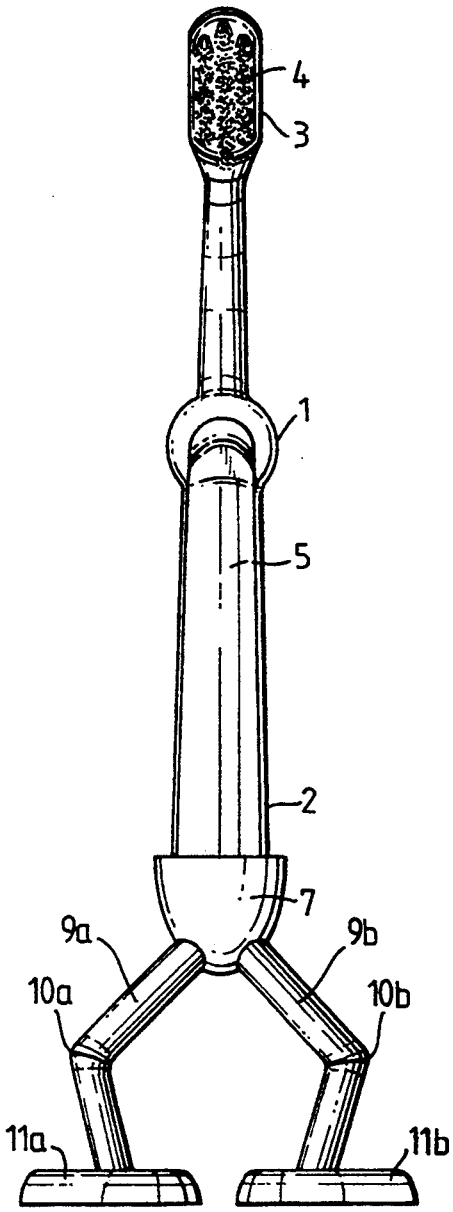
FIG. 2 shows a front view of a brush assembly according to the invention with the brush and stand assembled.
Figure 3:
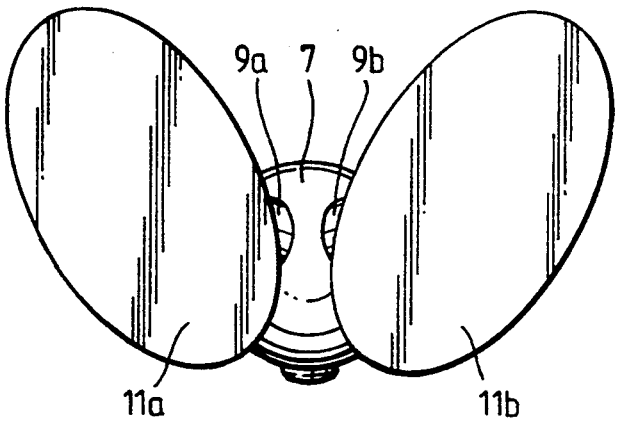
FIG. 3 shows an underneath plan view of a brush assembly according to the invention.

With regard to the figures, the embodiment of the invention drawn shows a brush 1, having an elongate handle 2. The brush also has a conventional type head 3, having attached thereto a plurality of bristles 4 arranged in tuftholes (not shown).

Attached to the front of brush 1 is an insert piece 5, which may be of a different material and/or color to handle 1. The end 6 of the brush remote from the head 3 is well rounded.

Handle 1 tapers from its broadest diameter of approximately 39 mm at its point most remote from the head of the brush and adjacent end 6, down to a diameter of approximately 32 mm nearer to the brush head. It has been found that the brush handle preferably has a handle diameter between approximately 30–40 mm, since this diameter of brush handle is readily grasped by young children when they are using a toothbrush. Additionally, a brush with this diameter of handle can more readily form a stable toothbrush assembly with the stand when assembled.

Stand 7 for the brush, which can be seen from FIG. 1, comprises a cup portion 8 which is shaped so as to have a substantially hemispherical shaped hollow, and to accommodate releasably by push fit the rounded end 6 of brush 1. The cup portion 8 and end portion 6 are molded such that they will engage each other with sufficient force to enable the brush 1 to be retained in the cup portion 8, but nevertheless to be readily pulled out of cup portion 8 by a user. The side walls of cup portion 8 are also shaped so as to retain brush 1 in a substantially upright position in use.

Cup portion 8 is supported on a pair of legs 9*a*, 9*b*, which have been shaped so as to have in them a couple of angular bends 10*a*, 10*b*, or "knees". The legs 9*a*, 9*b*, each have at the opposite end to cup portion 8 a foot 11*a*, 11*b*. Feet 11*a*, 11*b* are substantially oval in shape, though they may be any suitable shape which provides the desired stability and aesthetic appeal. The also have flattened soles to allow the stand to rest on a horizontal surface.

In this embodiment, the stand, and in particular the legs and feet of the stand, are specifically designed to provide aesthetic appeal in particular to children, by their caricature portrayal of legs and feet. In addition, the legs and feet are configured to ensure that the center of gravity of the assembled brush and stand is located in such a position that the assembly is stable and does not topple easily.

In connection with this, the exact size and configuration of the feet of the stand is important, but can readily be determined by the skilled man to establish an assembly which has the desirable stability characteristics. For example, the feet of the device may readily be shaped so as to resemble an actual human foot, with shaped toes, without detracting from the function that the feet are designed to perform.

I claim:

1. A toothbrush assembly comprising:

a toothbrush comprising a head portion and a handle portion, the head portion having a major surface and bristles orthogonally attached to the major surface, the handle having first and second ends, the first end being connected to the head portion; and a stand for releasably retaining the toothbrush, consisting essentially of a cup portion having a cavity with a mouth at an upper end thereof within which the second end of the handle can be accommodated;

a pair of legs separate and unattached to one another substantially along their entire length and spaced from each other on opposite sides of the cup portion in an arrangement that by themselves support the cup portion, each with an upper and lower end distant from one another, the upper end being connected to the cup portion, each of the legs consisting of a thigh and a calf segment, the thigh segment extending from the upper end of the leg downwards to a thigh joint end, the calf segment extending from the lower end of the leg upwards to a calf joint end, the thigh and calf joint ends being angularly connected to form a bent knee pointed outwardly away from the cup portion; and a foot for each leg, the foot being connected to the lower end of the respective leg, the foot having a sole forming a flat lower surface for supporting the stand on a horizontal surface external to the assembly and said mouth of the said cup portion being substantially parallel to each flat lower surface of said sole.

2. A toothbrush assembly according to claim 1 wherein cup portion is a substantially hemispherically shaped hollow oval.

3. A toothbrush assembly according to claim 1 wherein the handle tapers regularly outwardly towards the second end thereof.

4. A toothbrush assembly according to claim 1 wherein the handle portion has a diameter between 30 and 40 mm.

5. A toothbrush assembly according to claim 1 wherein the legs and the feet bear a resemblance to a caricature selected from the group consisting of a man and a cartoon character.

6. A toothbrush assembly according to claim 1 wherein each foot is of identical shape.

* * * * *